US008106830B2

(12) United States Patent
Ryou et al.

(10) Patent No.: US 8,106,830 B2
(45) Date of Patent: Jan. 31, 2012

(54) ANTENNA USING ELECTRICALLY CONDUCTIVE INK AND PRODUCTION METHOD THEREOF

(75) Inventors: Byung-Hoon Ryou, Seoul (KR); Won-Mo Sung, Gyeonggi-do (KR); Sang-Hoon Park, Seoul (KR)

(73) Assignee: EMW Co., Ltd., Incheon (KR)

( * ) Notice: Subject to any disclaimer, the term of this patent is extended or adjusted under 35 U.S.C. 154(b) by 377 days.

(21) Appl. No.: 11/993,172

(22) PCT Filed: Jun. 20, 2006

(86) PCT No.: PCT/KR2006/002350

§ 371 (c)(1),
(2), (4) Date: Sep. 29, 2009

(87) PCT Pub. No.: WO2006/137666

PCT Pub. Date: Dec. 28, 2006

(65) Prior Publication Data

US 2010/0045532 A1 Feb. 25, 2010

(30) Foreign Application Priority Data

Jun. 20, 2005 (KR) ..... 10-2005-0052931

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,763,058 | A | 6/1998 | Isen et al. | |
| 5,767,808 | A | 6/1998 | Robbins et al. | |
| 6,400,329 | B1 | 6/2002 | Barnes | |
| 6,590,545 | B2 | 7/2003 | McCorkle | |
| 6,621,462 | B2 | 9/2003 | Barnes | |
| 2002/0080076 | A1 | 6/2002 | Kamei et al. | |
| 2003/0017371 | A1 * | 1/2003 | Burrows et al. | 428/697 |
| 2004/0201522 | A1 * | 10/2004 | Forster | 343/700 MS |
| 2005/0001770 | A1 * | 1/2005 | Ikuta et al. | 343/700 MS |
| 2005/0062662 | A1 | 3/2005 | Miyoshi et al. | |

FOREIGN PATENT DOCUMENTS

JP 7-94933 4/1995

(Continued)

OTHER PUBLICATIONS

PCT Search Report for International Application No. PCT/KR2006/002350, mailed Oct. 19, 2006, 2 pages.

(Continued)

*Primary Examiner* — Hoanganh Le

(74) *Attorney, Agent, or Firm* — Blakely, Sokoloff, Taylor & Zafman LLP.

(57) ABSTRACT

Disclosed is an antenna having an antenna radiator formed by printing electrically conductive ink on a substrate. An antenna radiator according to an embodiment of the present invention is formed to the same thickness as a skin depth with respect to an operation frequency of the antenna. Therefore, an antenna can be fabricated using a small amount of electrically conductive ink while not reducing the gain of the antenna. Further, an antenna radiator according to another embodiment of the present invention is formed to the same thickness as a skin depth with respect to a predetermined frequency at a corresponding hot spot with respect to the frequency. Accordingly, an amount of electrically conductive ink used can be further reduced while maintaining the gain of the antenna.

13 Claims, 3 Drawing Sheets

FOREIGN PATENT DOCUMENTS

| | | | |
|---|---|---|---|
| JP | 2002-111351 | A | 4/2002 |
| JP | 2003-152428 | A | 5/2003 |
| JP | 2004-007527 | A | 1/2004 |
| KR | 2001-0096957 | | 11/2001 |
| KR | 10-0322385 | | 1/2002 |
| KR | 10-0323394 | | 1/2002 |
| KR | 10-0325031 | | 5/2002 |
| KR | 10-2002-0053737 | | 7/2002 |
| KR | 10-2002-0081096 | | 10/2002 |
| KR | 10-2002-0084639 | | 11/2002 |
| KR | 10-0365733 | | 12/2002 |
| KR | 2003-0089825 | | 11/2003 |
| KR | 10-2004-0049525 | | 6/2004 |
| KR | 10-2004-0066441 | | 7/2004 |
| KR | 10-2004-0089902 | | 10/2004 |
| KR | 10-2004-0108212 | | 12/2004 |
| KR | 10-2004-0111580 | | 12/2004 |
| KR | 10-2005-0010549 | | 1/2005 |
| KR | 10-2005-0052931 | | 6/2005 |
| KR | 10-0780554 | | 11/2007 |

OTHER PUBLICATIONS

IEEE 100 The Authoritative Dictionary of IEEE Standards Terms, Seventh Edition, Published by Standards Information Network, IEEE Pess, Published Dec. 2000, pp. 725, 805 and 1061.

KR 10-2005-0034429—Office Action pertaining to corresponding Korean application.

KR 10-2005-0034429—Allowance pertaining to corresponding Korean application.

KR 10-2005-0034430—Allowance pertaining to parent Korean application.

Non-Final Office Action pertaining to prior foreign application KR-10-2005-0052931, Sep. 16, 2005, 2 pages.

Decision of Refusal pertaining to prior foreign application KR-10-2005-0052931, Jan. 16, 2006, 2 pages.

Decision of Appeal pertaining to prior foreign application KR-10-2005-0052931, Dec. 20, 2006, 5 pages.

Non-Final Office action pertaining to prior foreign application—Divisional Application (KR-10-2006-0014656, Mar. 14, 2007, 3 pages.

Decision of Refusal pertaining to prior foreign application—Divisional Application KR-10-2006-0014656, Aug. 14, 2007, 3 pages.

Decision to grant pertaining to prior foreign application—Divisional Application KR-10-2006-0014656, Nov. 8, 2007, 2 pages.

First Office Action pertaining to corresponding Japanese application JP-2008-518026, Jun. 22, 2010, 2 pages.

Decision of Refusal pertaining to corresponding Japanese application JP-2008-518026, Oct. 12, 2010, 2 pages.

* cited by examiner

[Fig. 1]
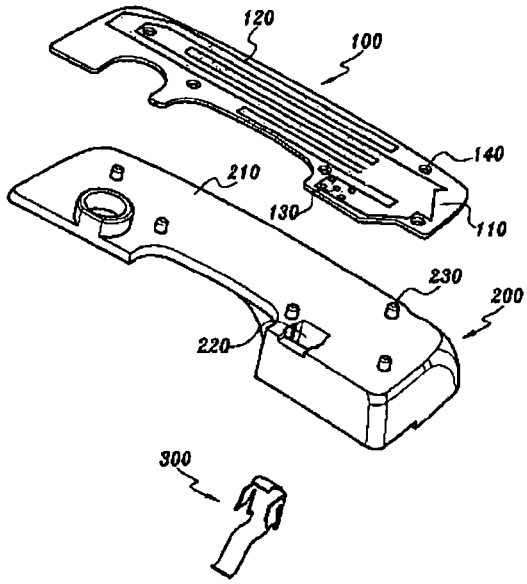
[Fig. 2]
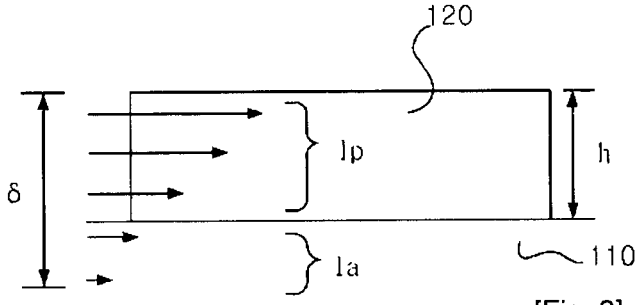
[Fig. 3]
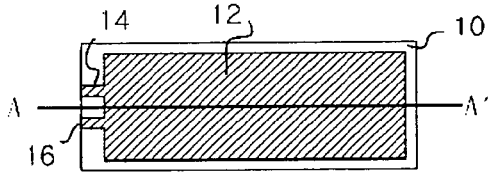
[Fig. 4]
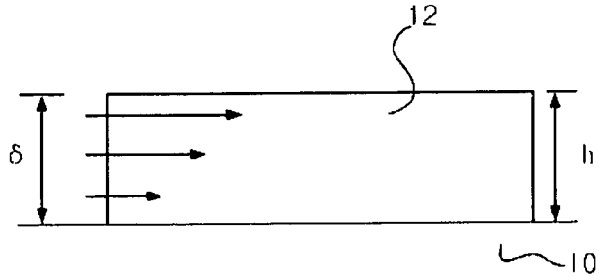
[Fig. 5]
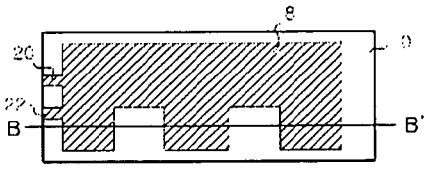

[Fig. 6]
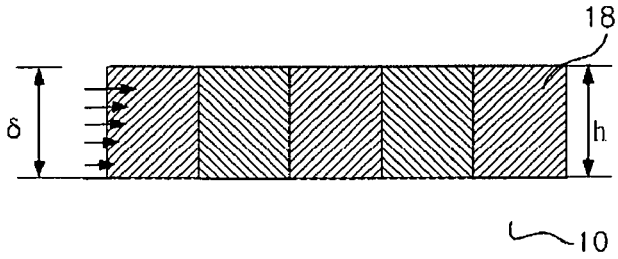
[Fig. 7]
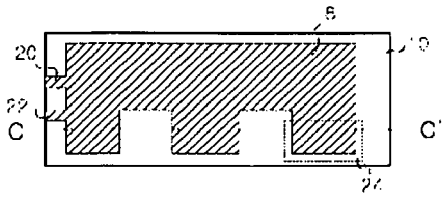
[Fig. 8]
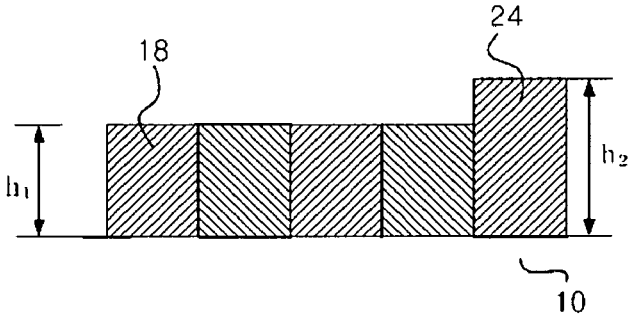
[Fig. 9]
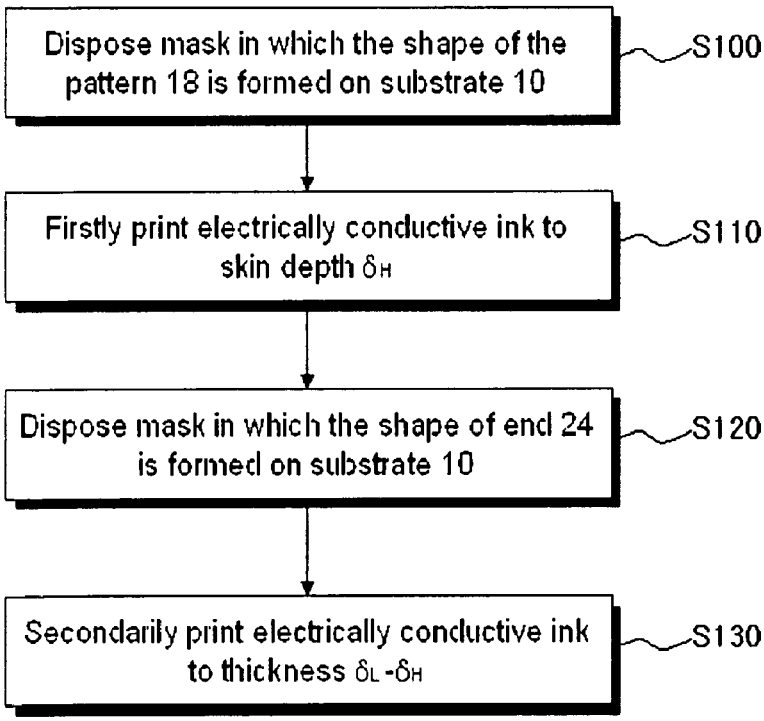

[Fig. 10]
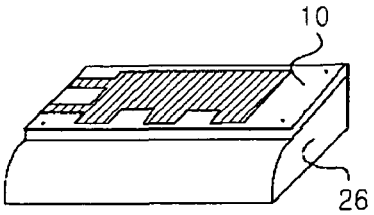
[Fig. 11]
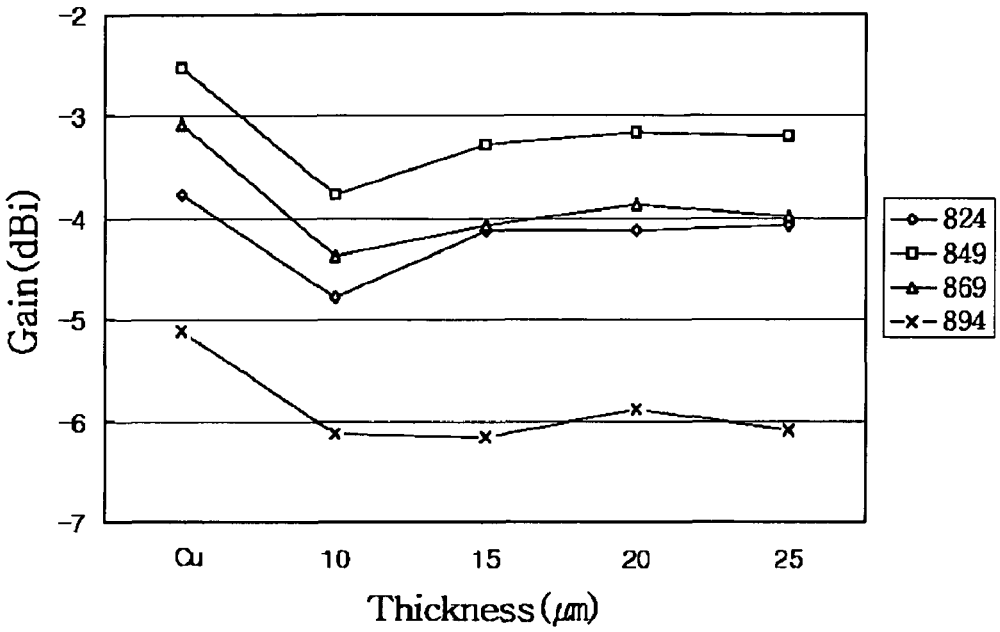
[Fig. 12]
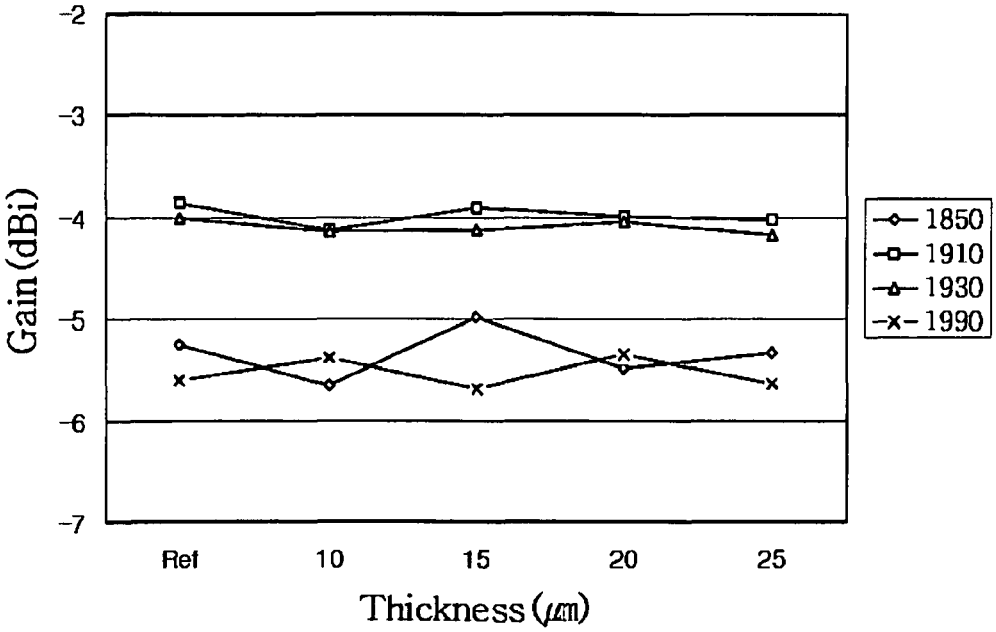

ANTENNA USING ELECTRICALLY CONDUCTIVE INK AND PRODUCTION METHOD THEREOF

CROSS-REFERENCE TO OTHER APPLICATIONS

This is a National Phase of International Application No. PCT/KR2006/002350, filed on Jun. 20, 2006, which claims priority from Korean Patent Application No. 10-2005-0052931, filed on Jun. 20, 2005.

TECHNICAL FIELD

The present invention relates, in general, to an antenna for wireless communication, and more particularly, to an antenna for wireless communication, in which an antenna radiator is formed of electrically conductive ink and the thickness of the radiator is determined according to a use frequency of an antenna.

BACKGROUND ART

In general, an antenna for wireless communication includes a feeding unit and a ground unit. The antenna further includes an antenna radiator connected to a RF circuit within a terminal device through the feeding unit and the ground unit, and a base supporting the antenna radiator.

The antenna radiator is formed of an electrically conductive material and has a pre-determined electrical length. Accordingly, the antenna radiator resonates at a target frequency to radiate and/or receive electromagnetic wave, and thus serves as a radiator. The antenna radiator may have a variety of shapes, such as a meander type, a helical type, a rectangular type, and a circular type, depending on its location and available space. The base is formed to support the antenna radiator and is also made of a dielectric material so that an effective wavelength of electromagnetic wave is reduced to reduce the electrical length of the antenna radiator.

Meanwhile, in recent years, as communication terminal devices are miniaturized and have light-weight, a built-in type antenna has been adopted increasingly. FIG. 1 is dismantled perspective view showing the conventional built-in type antenna. The conventional built-in type antenna includes a radiator unit 100 including a substrate 110 and a conductive antenna radiator 120 formed on the substrate, a base unit 200 supporting the radiator unit 100, and a terminal unit 300 that couples the antenna radiator 120 and a RF circuit (not shown). The terminal unit 300 is secured to the base unit 200 through a terminal hole 220. The radiator unit 100 is secured to the base unit 200 by a connection projection 230. If the terminal unit 300 is coupled to the base unit 200 and the radiator unit 100 is coupled to the base unit 200 as described above, a connection unit 130 of the antenna radiator 120 and the terminal unit 300 are electrically connected and the terminal unit 300 is coupled to the RF circuit, so that the antenna can operate.

In the conventional built-in type antenna constructed above, a conductor is generally deposited on the substrate 110 in order to form the antenna radiator 120. However, it is inconvenient and expensive to form the radiator 120 using the deposition process.

To solve the problem, a method of forming the antenna radiator 120 by printing electrically conductive ink on the substrate 10 has been proposed. The electrically conductive ink has conductivity since it contains micro-conductive particles such as silver (Ag). The electrically conductive ink can be printed on the substrate 110 and may serve as a radiator accordingly. The antenna radiator 120 can be formed by printing the electrically conductive ink on the substrate 110 in a predetermined shape through a method such as silkscreen printing. If the antenna radiator 120 is formed of the electrically conductive ink, the printing process is very simple, the productivity is very high, and various shapes of radiators can be formed.

If the antenna radiator is formed of the electrically conductive ink, however, there is a problem in that the gain of the antenna is low. Furthermore, since the electrically conductive ink is very expensive, the production cost of the antenna rises.

Therefore, there is a need for an antenna using electrically conductive ink and manufacturing method thereof, in which a manufacturing process of an antenna can be simplified, degree of freedom of design can be increased, a good gain can be obtained, and the production cost is low.

DISCLOSURE OF INVENTION

Technical Problem

An object of the present invention is to provide an antenna using electrically conductive ink and manufacturing method thereof, in which a good gain can be obtained.

Another object of the present invention is to provide an antenna using electrically conductive ink and manufacturing method thereof, in which the production cost can be saved.

Technical Solution

In general, if electromagnetic wave propagates in a conductor, the electromagnetic wave is attenuated by an attenuation constant α given in following equation.

$$\alpha=\sqrt{\pi f\mu\sigma} \qquad \text{MathFigure 1}$$

where f:the frequency

μ: the permeability of the conductor

σ: the conductivity of the conductor

Therefore, the electromagnetic wave in the conductor is attenuated to 1/e and substantially disappears below a skin depth δ given in the following equation, and a current accordingly is limited within the skin depth δ. This is called a skin effect.

$$\delta = 1/\alpha = \frac{1}{\sqrt{\pi f \mu \sigma}} \qquad \text{MathFigure 2}$$

From Equation 2, it can be seen that the higher the frequency of the electromagnetic wave, the smaller the skin depth, and the lower the frequency of the electromagnetic wave, the greater the skin depth. For example, copper has a skin depth of 0.0038 mm in 3 MHz, but has a skin depth of 0.66 μm in 10 GHz.

As a result of an experiment performed by taking notice of the fact, the inventors of the present invention have found that the conventional antenna using the electrically conductive ink has a low gain due to the current loss resulting from the skin effect. In more detail, if the skin depth is greater than the thickness of the antenna radiator, loss is generated since a portion of electromagnetic wave is shielded by the substrate. Referring to FIG. 2, currents Ip and Ia flow within the skin depth δ. If the thickness h of the radiator is smaller than the skin depth δ, however, the current Ia in a portion exceeding the thickness h flows through the substrate 110 not through the conductor radiator 120. Consequently, a portion of the current Ia cannot propagate and is lost. Therefore, the gain of the antenna is reduced and the characteristic of the antenna is degraded.

In contrast, if the thickness of the radiator 120 is greater than the skin depth, there is no loss of the current and no reduction of the antenna gain. However, the radiator (120) portion higher than the skin depth rarely affects the characteristic of the antenna. Therefore, the inventors of the present invention found that an amount of electrically conductive ink used can be reduced while maintaining the performance of an antenna and the production cost of the antenna can be saved accordingly, by setting the thickness of the radiator 120 to a skin depth corresponding to the used frequency of the antenna. The present invention is based on these discoveries. In accordance with an embodiment of the present invention, there is provided an antenna for wireless communication, including a substrate and an antenna radiator formed by printing electrically conductive ink on the substrate, wherein the radiator has a thickness which is substantially the same as a skin depth of the radiator with respect to a resonant frequency of the antenna.

It is preferred that the antenna has two or more resonant frequencies, and said skin depth is a skin depth of the radiator with respect to the lowest resonant frequency of the resonant frequencies.

Furthermore, the resonant frequency may be in the range of 824 to 894 MHz.

Meanwhile, it is preferred that the electrically conductive ink contains 65 to 70% by weight of silver (Ag) particles.

According to another embodiment of the present invention, there is provided an antenna for wireless communication, including a substrate and an antenna radiator formed by printing electrically conductive ink on the substrate, wherein a thickness of the radiator at a hot spot in the radiator with respect to a resonant frequency of the antenna is substantially the same as a skin depth of the radiator with respect to the resonant frequency.

It is preferred that the antenna has two or more resonant frequencies, and said skin depth is a skin depth of the radiator with respect to the lowest resonant frequency of the resonant frequencies.

It is also preferred that the thickness of the radiator other than the hot spot is substantially the same as a skin depth of the radiator with respect to the highest resonant frequency of the resonant frequencies.

Furthermore, the resonant frequency may be in the range of 824 to 894 MHz.

Meanwhile, it is preferred that the electrically conductive ink contains 65 to 70% by weight of silver (Ag) particles.

In accordance with still another embodiment of the present invention, there is provided an antenna for wireless communication, including a substrate and an antenna radiator formed by printing electrically conductive ink on the substrate, and having two or more resonant frequencies, wherein a thickness of the radiator at a hot spot in the radiator with respect to each of the resonant frequencies is substantially the same as a skin depth of the radiator with respect to each of the resonant frequencies, respectively.

It is preferred that the electrically conductive ink contains 65 to 70% by weight of silver (Ag) particles.

In accordance with still another embodiment of the present invention, there is provided a method of manufacturing an antenna for wireless communication, wherein the antenna includes a substrate and an antenna radiator formed by printing electrically conductive ink on the substrate. The method comprises printing the electrically conductive ink on the substrate to a first thickness in the shape of the antenna radiator; and printing the electrically conductive ink to a second thickness at a first hot spot in the radiator with respect to a first frequency, wherein the second thickness is a thickness such that the thickness of the radiator at the first hot spot is substantially a skin depth of the radiator with respect to the first frequency.

It is preferred that the first frequency is the lowest resonant frequency of resonant frequencies of the antenna.

Furthermore, it is preferred that the first thickness is substantially a skin depth of the radiator with respect to the highest resonant frequency of resonant frequencies of the antenna.

Meanwhile, preferably, the method further comprises printing the electrically conductive ink to a third thickness at a second hot spot in the radiator with respect to a second frequency, wherein the third thickness is a thickness such that the thickness of the radiator at the second hot spot is substantially a skin depth of the radiator with respect to the second frequency.

Advantageous Effects

According to the present invention, since the loss of current in an antenna can be prevented, an antenna with a good gain can be fabricated using electrically conductive ink through a simple process.

Furthermore, according to the present invention, since an amount of expensive electrically conductive ink used can be minimized without affecting the performance of the antenna, the antenna can be fabricated at low cost.

BRIEF DESCRIPTION OF THE DRAWINGS

Further objects and advantages of the invention can be more fully understood from the following detailed description taken in conjunction with the accompanying drawings in which:

FIG. 1 is dismantled perspective view showing a conventional built-in type antenna;

FIG. 2 is a view illustrating the loss of current by a thickness of a radiator;

FIG. 3 is a top view of a single band antenna according to a first embodiment of the present invention;

FIG. 4 is a cross-sectional view of the antenna taken along line A-A' in FIG. 3;

FIG. 5 is a top view of a dual band antenna according to a second embodiment of the present invention;

FIG. 6 is a cross-sectional view of the antenna taken along line B-B' in FIG. 5;

FIG. 7 is a top view of a dual band antenna according to a third embodiment of the present invention;

FIG. 8 is a cross-sectional view of the antenna taken along line C-C' in FIG. 7;

FIG. 9 is a flowchart illustrating a method of manufacturing an antenna according to an embodiment of the present invention;

FIG. 10 illustrates an example in which the antenna is applied according to an embodiment of the present invention;

FIG. 11 is a graph illustrating variation in the gain depending on the thickness of the antenna radiator in the frequency band of GSM 850; and FIG. 12 is a graph illustrating variation in the gain depending on the thickness of the antenna radiator in the frequency band of USPCS.

MODE FOR THE INVENTION

The present invention will now be described in detail in connection with specific embodiments with reference to the accompanying drawings.

FIG. 3 is a top view of a single band antenna according to a first embodiment of the present invention, and FIG. 4 is a cross-sectional view of the antenna taken along line A-A' in FIG. 3. Referring to FIG. 3, the antenna of the present embodiment includes an antenna radiator 12 formed of electrically conductive ink on the substrate 10 through printing, and a ground unit 14 and a feeding unit 16 formed in the antenna radiator 12. The electrically conductive ink used to form the antenna radiator 12 may be known one, but preferably a mixture of 65 to 70% by weight of silver (Ag) and 30 to 35% by weight of an additive. The additive may be a mixture of resin, a drying agent, and a dispersing agent. The resin serves to prevent a direct contact between silver (Ag) and oxygen in order to prevent corrosion. The drying agent serves to accelerate the dry of ink, reducing the manufacturing time of an antenna. The dispersing agent serves to increase the dispersibility of silver particles.

Meanwhile, in order to facilitate printing, the viscosity of the electrically conductive ink may be set in the range of 20,000 to 24,000 cps. It is also possible to improve the interconnectivity between silver (Ag) particles by making the particles minute in various sizes and forming them in a plate shape.

Referring to FIG. 4, a thickness h of the antenna radiator 12 may be substantially a skin depth δ of the radiator 12 in an antenna frequency used. The antenna of the present embodiment is a single band antenna and is therefore designed to have a single resonant frequency at a frequency at which the antenna will be used. Therefore, when the thickness h is set to the skin depth δ corresponding to a frequency used, electromagnetic wave can be transferred along the antenna radiator 12 substantially without loss. Accordingly, the gain of the antenna can be prevented from lowering. Furthermore, if the thickness h is set greater than the skin depth δ as described above, that does not have an effect on the characteristic of the antenna. Therefore, an amount of electrically conductive ink used to form the radiator 12 can be minimized by setting the thickness h of the radiator 12 to be the same as the skin depth δ. It allows a minimum amount of expensive electrically conductive ink to be used and the production cost of the antenna to be saved. Furthermnore, since the antenna of the present embodiment can be formed through one printing process, a manufacturing process can be simplified and the productivity can be improved.

FIG. 5 is a top view of a dual band antenna according to a second embodiment of the present invention, and FIG. 6 is a cross-sectional view of the antenna taken along line B-B' in FIG. 5. The antenna of the present embodiment includes an antenna radiator 18 formed by printing electrically conductive ink on a substrate 10. A ground unit 20 and a feeding unit 22 are also formed in the antenna radiator 18. The antenna radiator 18 can be formed by printing the same electrically conductive ink as that of the previous embodiment. Meanwhile, the antenna radiator 18 of the present embodiment is printed in an E shape, as shown in FIG. 5, and accordingly has a dual band characteristic. However, those having skilled in the art will easily understand that the shape of the radiator 18 is not limited to the E shape, but may have a variety of shapes, such as a meander type, a rectangular type, a triangular shape, and a circular shape, depending on a frequency band of an antenna and a multi-band characteristic.

Referring to FIG. 6, the thickness h of the antenna radiator 18 may be substantially the same as the skin depth δ. The antenna of the present embodiment is a dual band antenna and has two resonant frequencies; a resonant frequency $f_L$ of a lower frequency band and a resonant frequency $f_H$ of a higher frequency band. Since the skin depth is greater with respect to a lower frequency as described above, loss by the skin effect is greater with respect to a lower frequency. Therefore, the thickness h of the radiator 18 can be set to the skin depth $\delta_L$ of the radiator 18 with respect to the lower resonant frequency $f_L$ in accordance with the following equation.

$$\delta_L = \frac{1}{\sqrt{\pi f_L \mu \sigma}}$$

MathFigure 3

In this case, loss is not generated with respect to not only electromagnetic wave of the lower frequency, but also electromagnetic wave of the higher frequency. A reduction in the gain of the antenna can also be prevented.

Furthermore, the skin depth $\delta_L$ is a minimal thickness for securing a good antenna characteristic with respect to both the electromagnetic waves of the high frequency and the low frequency. Thus, if the thickness of the radiator 18 is set to the skin depth $\delta_L$, an amount of electrically conductive ink used to form the radiator 18 can be minimized, while maintaining the characteristic of the antenna, and the production cost of the antenna can be saved. By forming the antenna radiator 18 with thickness equal to the skin depth with respect to a resonant frequency of a low frequency through the printing of the electrically conductive ink as described above, an antenna having a good gain can be fabricated at a minimal cost through one printing process.

The principle of the second embodiment may be applied to not only a dual band antenna, but also a triple or more band antennas. By setting the thickness of the antenna radiator to a skin depth with respect to the lowest resonant frequency of several resonant frequencies, a triple or more band antenna with a good gain can be fabricated through one printing process to reduce production cost. In this case, a multi-band characteristic of triple or more bands can be obtained by forming the radiator 18 in various shapes, such as a meander line and a patch with a slot. Such modification falls within a scope that can be easily understood by those skilled in the art.

FIG. 7 is a top view of a dual band antenna according to a third embodiment of the present invention, and FIG. 8 is a cross-sectional view of the antenna taken along line C-C' in FIG. 7. The antenna of the present embodiment includes an antenna radiator 18 formed by printing electrically conductive ink on a substrate 10. A ground unit 20 and a feeding unit 22 are also formed in the antenna radiator 18. The antenna radiator 18 can be formed by printing the same electrically conductive ink as that of the previous embodiment. The antenna radiator 18 of the present embodiment is printed in an E shape, and accordingly has a dual band characteristic. However, those having skilled in the art will easily understand that the shape of the radiator 18 is not limited to the E shape, but may have a variety of shapes, such as a meander type, a rectangular type, a triangular shape, and a circular shape, depending on a frequency band of an antenna and a multi-band characteristic.

In general, the dual band antenna has two resonant frequencies, and the antenna radiator 18 radiates and/or receives electromagnetic waves of two kinds of frequencies. An amount of electromagnetic wave (and thus a current) has its maximum at different locations on the radiator 18 depending upon the respective frequencies. The locations may be determined according to the shape of an antenna and corresponding frequency. A point at which the current is maximum as described above is called "a hot spot" in the present description. The gain of the whole antenna is dependent on a reduction of the gain at the hot spot. Therefore, by preventing a reduction of the gain at the hot spot, the gain of the whole antenna can be improved.

Referring to FIG. 7, in the antenna of the present embodiment, the hot spot with respect to a low frequency current is a radiator end 24. Since a reduction in the gain of the antenna is connected with the skin effect as described above, the reduction of the gain at the radiator end 24 can be prevented by setting the thickness of the radiator in the radiator end 24 to be substantially the same as the skin depth of the radiator.

In more detail, as shown in FIG. 8, a thickness $h_1$ of the radiator other than the end 24 may be set to a skin depth of the radiator with respect to the resonant frequency $f_H$ of a high frequency in accordance with the following equation.

$$\delta_H = \frac{1}{\sqrt{\pi f_H \mu \sigma}}$$

MathFigure 4

Meanwhile, a thickness $h_2$ of the radiator at the end 24 can be set to the skin depth $\delta_L$ with respect to the resonant frequency $f_L$ of a lower frequency in accordance with Equation 3 above.

If the thickness of the radiator 18 is set to the skin depths $\delta_H$ and $\delta_L$ as described above, an antenna radiator with a good gain can be formed using a minimum amount of electrically conductive ink. Particularly, by setting only the thickness $h_2$ of the radiator at a hot spot with respect to a lower frequency to the skin depth $\delta_L$ of a lower frequency unlike the previous embodiment, an amount of electrically conductive ink used can be further reduced compared with the previous embodiment while substantially preventing a reduction in the gain of the antenna and the production cost of the antenna can be further saved.

A method of manufacturing the antenna of the present embodiment will be described below with reference to FIGS. 7 and 9.

In step S100, a screen in which the shape of the antenna radiator 18 is formed is first disposed on the substrate 10. Electrically conductive ink is then printed on the screen to a thickness substantially equal to the skin depth $\delta_H$, thus forming an overall antenna radiator (step S110).

In step S120, a screen in which the shape of the end 24 is formed is disposed on the substrate 10 on which the radiator 18 is printed. The location and shape of the end 24 may be the same as those of the hot spot of the antenna. The location and shape of the hot spot can be predicted at the time of designing the antenna. Furthermore, after the first printing in step S 110, current distributions in the antenna can be measured in order to know the location and shape of the hot spot. In this case, the location and shape of the hot spot can be measured once, and the same location and shape may be used afterward for the antenna radiator 18 of the same shape.

Finally, in step S130, electrically conductive ink is secondarily printed so that the thickness of the end 24 becomes substantially the skin depth $\delta_L$, thereby completing the formation of the antenna radiator 18. For the radiator having the thickness $\delta_H$ has already been formed in step S110, only the electrically conductive ink of a thickness $\delta_L - \delta_H$ can be further printed in this step.

According to the method of manufacturing the antenna of the present embodiment, it is possible to manufacture an antenna without the gain reduced, while saving the production cost of the antenna by using small amount of conductive material.

The third embodiment has been described regarding the dual band antenna. However, the principle of the present embodiment may be applied to an antenna of triple or more bands. In this case, an overall antenna radiator may be formed to a skin depth with respect to the highest resonant frequency, and the radiator may be formed to the skin depths for the second resonant frequency and the third resonant frequency at the hot spots for the second resonant frequency and the third resonant frequency, respectively. Therefore, a good gain can be obtained for a number of frequency bands while using a minimum amount of electrically conductive ink. Meanwhile, a multi-band characteristic of triple or more bands can be obtained by forming the radiator 18 in various forms, such as a meander line and a patch with a slot. Such modification falls within a scope that can be easily understood by those skilled in the art.

Furthermore, in the method of manufacturing the antenna having triple or more bands, additional printing can be performed to a thickness of a skin depth for each frequency. For example, when a skin depth for the lowest resonant frequency $f_{LOWEST}(<f_L)$ of a triple band antenna is $\delta_{LOWEST}$, if the hot spot for the lowest resonant frequency $f_{LOWEST}$ is overlapped with a hot spot for the frequency $f_L$, a step of printing the electrically conductive ink to a thickness $\delta_{LOWEST-\delta L}$ in the overlapping region may be further added after the step S130.

Meanwhile, the antennas of the first to third embodiments may be used with them being coupled to the ground unit and the feeding unit of the RF circuit within the terminal device. Furthermore, in order for the antenna to be easily connected with the RF circuit and to be fixed stably, the substrate 10 in which the antenna radiator is printed may be disposed on the base 26 of the dielectric material as shown in FIG. 10. In this case, the antenna radiator on the substrate 10 may be connected to the RF circuit through an additional terminal unit (not shown), which can be contained within the base 26.

FIGS. 11 and 12 are plots illustrating variation in the gain depending on the thickness of the antenna radiator in frequency bands of GSM 850 and USPCS, respectively.

Skin depths of electrically conductive ink used in respective frequencies are as follows, which are obtained based on the measurement of the resistivity.

TABLE 1

| | Frequency (MHz) | | | |
|---|---|---|---|---|
| | 824 | 894 | 1850 | 1990 |
| Skin depth (□) | 11.497 | 11.038 | 7.673 | 7.398 |

The plots of FIG. 11 show variation in the gain depending on the thickness of the radiator at 824 MHz, 849 MHz, 869 MHz, and 894 MHz. From FIG. 11, it can be seen that when a thickness of printed electrically conductive ink rises from about 10 μm, which is smaller than the skin depth, to about 15 μm, which is greater than the skin depth, the gains abruptly rise. And increase in the thickness greater than the above-mentioned thickness did not have a great effect on the antenna gain. Therefore, it was found that if the radiator is formed to the thickness of the skin depth with respect to a low frequency of about 850 MHz band, a reduction in the gain of the antenna could be prevented, and the thickness of the radiator could be minimized, while not affecting the performance of the antenna.

Plots of FIG. 12 show variation in the gain depending on the thickness of the radiator at 1850 MHz, 1910 MHz, 1930 MHz, and 1990 MHz. From FIG. 11, it can be seen that there is almost no variation in the gain depending on variation in the thickness of the radiator at a high frequency of 1.8 to 1.9 GHz. However, it is noted that the effect was not shown on the graph because the skin depth of the electrically conductive ink was less than 10 □. Although, it was found that the improvement of the antenna gain is relatively more practical at a low frequency band.

Although the present invention have been disclosed referring to the specific embodiments which are given for the purpose of illustration not for limitation, those skilled in the art will appreciate that various modifications, additions and substitutions are possible, without departing from the scope and spirit of the invention. For example, the principle of the present invention may be applied to a variety of devices that transmit and/or receive RF signals, such as an antenna printed on a housing of a wireless communication terminal device and RFID tag including a printed conductive antenna radiator. Therefore, the scope of the present invention must be limited by only the following claims and equivalents thereof.

What is claimed:

1. An antenna for wireless communication comprising:

a substrate; and an antenna radiator formed by printing electrically conductive ink on the substrate, wherein the radiator has a thickness that is substantially the same as a skin depth of the radiator with respect to a resonant frequency of the antenna, wherein the antenna has two or more resonant frequencies, and said skin depth is a skin depth of the radiator with respect to the lowest resonant frequency of the resonant frequencies.

2. The antenna of claim 1, wherein the resonant frequency is in the range of 824 to 894 MHz.

3. The antenna of claim 1, wherein the electrically conductive ink contains 65 to 70% by weight of silver (Ag) particles.

4. An antenna for wireless communication comprising:

a substrate; and an antenna radiator formed by printing electrically conductive ink on the substrate, wherein a thickness of the radiator at a hot spot in the radiator with respect to a resonant frequency of the antenna is substantially the same as a skin depth of the radiator with respect to the resonant frequency, wherein a hot spot is a point at which current is at a maximum, wherein the antenna has two or more resonant frequencies, and said skin depth is a skin depth of the radiator with respect to the lowest resonant frequency of the resonant frequencies.

5. The antenna of claim 4, wherein the thickness of the radiator other than the hot spot is substantially the same as a skin depth of the radiator with respect to the highest resonant frequency of the resonant frequencies.

6. The antenna of claim 4, wherein the resonant frequency is in the range of 824 to 894 MHz.

7. The antenna of claim 4, wherein the electrically conductive ink contains 65 to 70% by weight of silver (Ag) particles.

8. An antenna for wireless communication comprising:

a substrate; and an antenna radiator formed by printing electrically conductive ink on the substrate, and having two or more resonant frequencies, wherein a thickness of the radiator at a hot spot in the radiator with respect to each of the resonant frequencies is substantially the same as a skin depth of the radiator with respect to each of the resonant frequencies, respectively, wherein a hot spot is a point at which current is at a maximum.

9. The antenna of claim 8, wherein the electrically conductive ink contains 65 to 70% by weight of silver (Ag) particles.

10. A method of manufacturing an antenna for wireless communication, the antenna including a substrate and an antenna radiator formed by printing electrically conductive ink on the substrate, the method comprising:

printing the electrically conductive ink on the substrate to a first thickness in the shape of the antenna radiator; and printing the electrically conductive ink to a second thickness at a first hot spot in the radiator with respect to a first frequency, wherein the second thickness is a thickness such that the thickness of the radiator at the first hot spot is substantially a skin depth of the radiator with respect to the first frequency, wherein a hot spot is a point at which current is at a maximum.

11. The method of claim 10, wherein the first frequency is the lowest resonant frequency of resonant frequencies of the antenna.

12. The method of claim 10, wherein the first thickness is substantially a skin depth of the radiator with respect to the highest resonant frequency of resonant frequencies of the antenna.

13. The method of claim 10, further comprising pinting the electrically conductive ink to a third thickness at a second hot spot in the radiator with respect to a second frequency, wherein the third thickness is a thickness such that the thickness of the radiator at the second hot spot is substantially a skin depth of the radiator with respect to the second frequency.

* * * * *